US005507687A

United States Patent [19]

Takemoto et al.

[11] Patent Number: 5,507,687

[45] Date of Patent: Apr. 16, 1996

[54] MEDAL CLEANING APPARATUS

[75] Inventors: Takatoshi Takemoto; Yoichi Yoneda, both of Tokyo, Japan

[73] Assignee: Kabushiki Kaisha Ace Denken, Japan

[21] Appl. No.: 366,045

[22] Filed: Dec. 29, 1994

[30] Foreign Application Priority Data

Jun. 19, 1992 [JP] Japan ..... 4-161458

[51] Int. Cl.[6] ..... B24B 31/16

[52] U.S. Cl. ..... 451/104; 15/3; 451/113

[58] Field of Search ..... 451/74, 104, 113; 15/3, 93.1; 134/104.3

[56] References Cited

FOREIGN PATENT DOCUMENTS

| | | | |
|---|---|---|---|
| 259370 | 12/1985 | Japan | 451/113 |
| 259371 | 12/1985 | Japan | 451/113 |
| 2-149285 | 12/1990 | Japan . | |
| 3-242186 | 10/1991 | Japan . | |

*Primary Examiner*—Philip R. Coe
*Attorney, Agent, or Firm*—Andrus, Sceales, Starke & Sawall

[57] ABSTRACT

A medal cleaning apparatus for mixing and jumbling medals and cleaning material, cleaning the medals, separating the medals and the cleaning material and then expelling the medals comprises a transporting pipe, the lower end of the transporting pipe having an inlet for taking-in the medals and the cleaning material and the upper end of the transporting pipe becoming a medal expulsion outlet, a spiral member, installed within the transporting pipe, for mixing, jumbling and transporting the medals and the cleaning material, a driving mechanism for rotating the spiral member, a filter, set up around and extending from one side of the upper end of the transporting pipe, and a return pipe for guiding the cleaning material separated at the filter to the lower end of the transporting pipe, with the filter being arranged so as to be inclined downwards in the direction of progress of the medals and the plane of the medal expulsion outlet at the upper end of the transporting pipe being inclined downwards in the direction of expulsion of the medals so as to follow the incline of the filter.

4 Claims, 3 Drawing Sheets

MEDAL CLEANING APPARATUS

BACKGROUND OF THE INVENTION

1. Field of The Invention

The present invention relates to a medal cleaning apparatus for mixing, jumbling and then cleaning medals for use in, for example, slot machines etc.

2. Description of The Related Art

This kind of medal cleaning apparatus is disclosed in, for example, Japanese Patent Laid-Open Publication Hei. 3-242186. Here, the apparatus is constructed from a pipe, a spiral member installed within the pipe, a driving mechanism for rotating the spiral member and a filter set-up on the outside of the upper end of the pipe. In this apparatus, medals are introduced together with cleaning material at the lower end of the pipe and the spiral member is rotated. The medals and the cleaning material are then mixed and jumbled together and the medals are cleaned by coming into contact with the cleaning material. The medals and the cleaning material are transported in the direction of the upper end of the pipe as they are jumbled together by the spiral member and are then expelled from the upper end of the pipe. The expelled medals and cleaning material are then separated by the filter, with the cleaning materials separated by the filter being used again.

A pachinko ball cleaning apparatus similar to the aforementioned medal cleaning apparatus is disclosed in Japanese Utility Model Laid-Open Publication Hei. 2-149285. In this apparatus, metal pachinko balls and cleaning material are mixed and jumbled together by a pipe and spiral member before being separated from each other by a filter.

In these cleaning apparatus, the upper end of the pipe has been cut horizontally, although this kind of structure did not present a problem for the pachinko ball cleaning apparatus. However, in the case of the medal cleaning apparatus, a problem occurred where the medals were not expelled smoothly. Research by the applicant for the present invention revealed that medals were becoming stuck in the expulsion portion at the upper end of the pipe. Therefore, it is a problem that the stuck medals must be removed by hand every time the trouble occurs. Investigations carried out by the applicant with regards to this were as follows.

First, the filter was inclined with respect to the circumference of the upper end of the pipe so as to make it easy for the medals to slip off. i.e. the surface of the filter was inclined with respect to the plane of the opening at the upper end of the pipe. A step difference therefore occurred between one side of the upper end of the pipe and the filter. On the other hand, however, the medals were ejected from the upper end of the pipe as a result of being pushed by the spiral member. The falling speed of the medals at the time of ejection was therefore almost zero or in the region of zero. As a result of this, depending on the position of the medals at the time of expulsion, the medals were observed to become held-up as a result of leaning against the side wall of the pipe protruding at the step difference portion. Also, the medals were expelled at the plane of the opening for the pipe radially as a result of the pushing action of the spiral body. This means that medals were also expelled from the rear of the pipe, i.e. the opposite side of the pipe from which it was intended to expel the medals from. This therefore served as a hindrance at the upper end of the pipe and it was at this portion at which hold-ups occurred.

SUMMARY OF THE INVENTION

As the present invention sets out to take the kind of problems encountered in the related art into account, it's object is to provide a medal cleaning apparatus from which the medals are expelled in a smooth manner after cleaning.

Therefore, in order to achieve the aforementioned object, in the present invention a medal cleaning apparatus for mixing and jumbling medals and cleaning material, cleaning the medals, separating the medals and the cleaning material and then expelling the medals comprises: a transporting pipe, the lower end of the transporting pipe having an inlet for taking-in the medals and the cleaning material and the upper end of the transporting pipe becoming a medal expulsion outlet; a spiral member, installed within the transporting pipe, for mixing, jumbling and transporting the medals and the cleaning material; a driving mechanism for rotating the spiral member; a filter, set up around and extending from one side of the upper end of the transporting pipe; and a return pipe for guiding the cleaning material separated at the filter to the lower end of the transporting pipe. The filter is then arranged in such a manner as to be inclined downwards in the direction of progress of the medals. Also, the plane of the medal expulsion outlet at the upper end of the transporting pipe is inclined downwards in the direction of expulsion of the medals in such a manner as to follow the incline of the filter.

The plane of the medal expulsion outlet at the upper end of the transporting pipe may, for example, be almost parallel with the surface of the filter.

The apparatus may also be further equipped with an auxiliary filter positioned at a part of surroundings of the upper end of the transporting pipe.

DETAILED DESCRIPTION OF THE PREFERRED EMBODIMENTS

Figure 1:
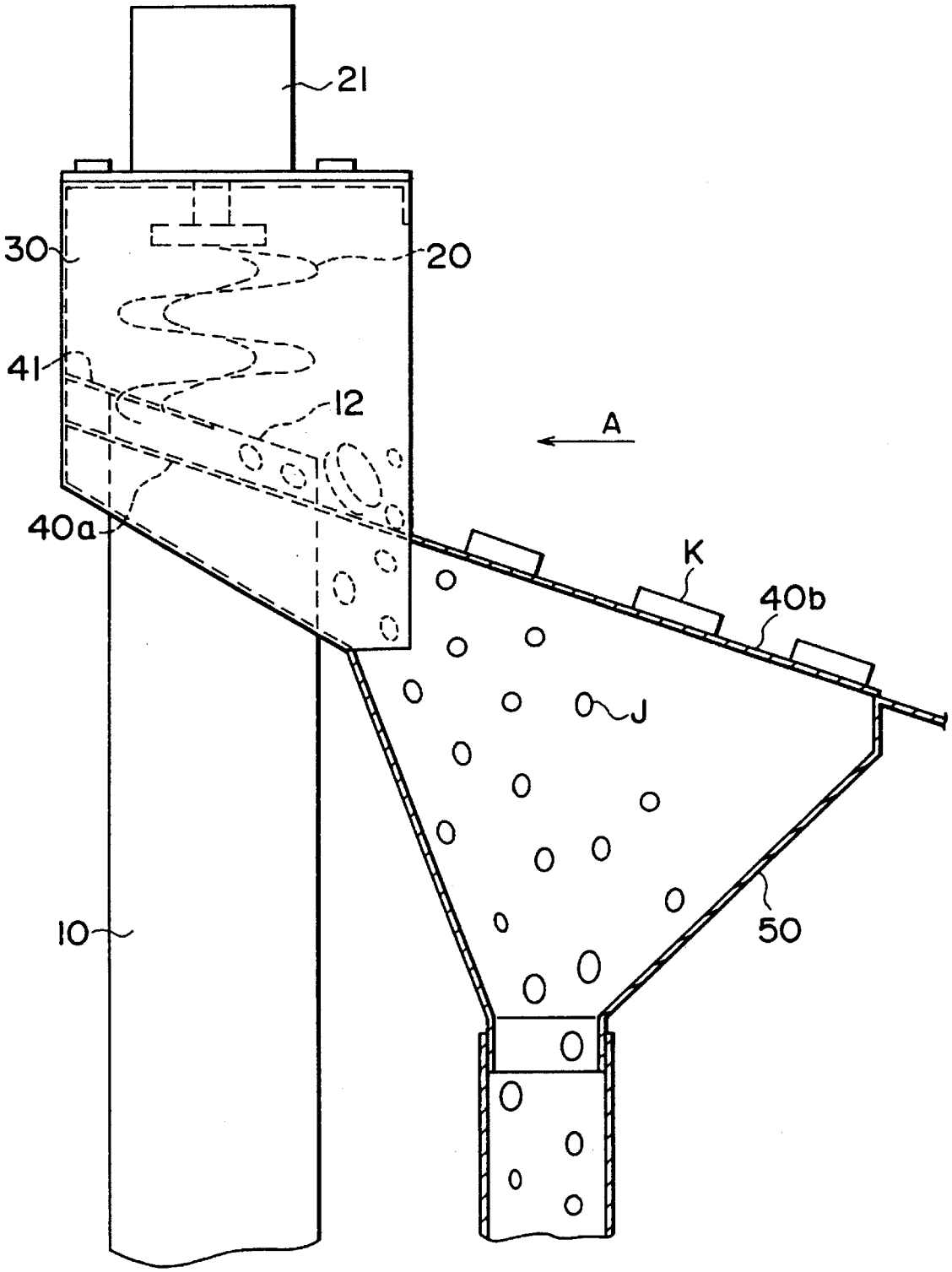
FIG. 1 is a side-view showing the essential parts of a medal cleaning apparatus for an embodiment of the present invention.
Figure 2:
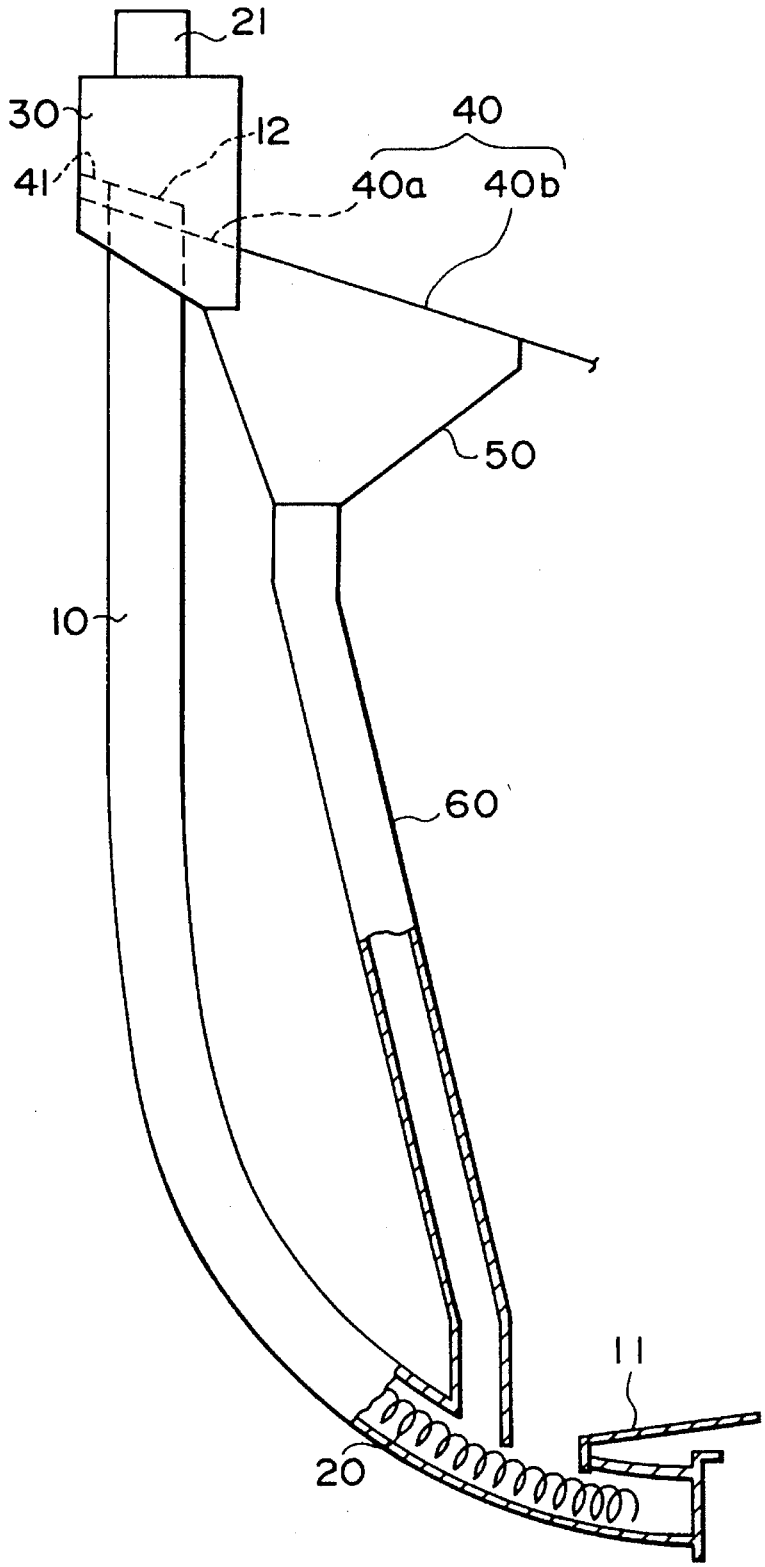
FIG. 2 is a side-view showing the whole of the medal cleaning apparatus for the embodiment of the present invention.
Figure 3:
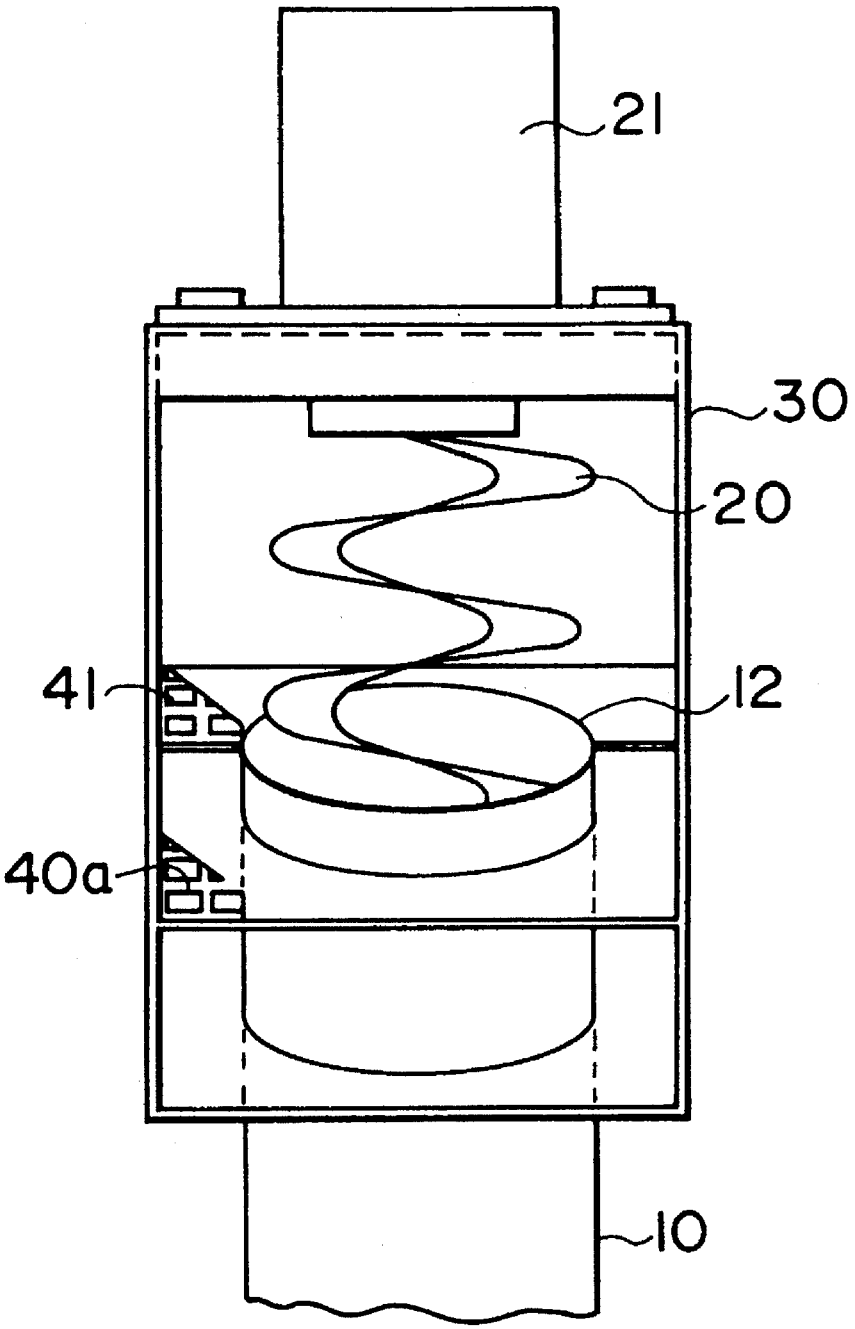
FIG. 3 is a view taken in a direction A of FIG. 1.

The following is a description of an embodiment of the present invention based on FIGS. 1 to 3.

As shown in FIG. 2, the medal cleaning apparatus in this embodiment is equipped with: a transporting pipe 10; a spiral member 20 installed within the transporting pipe 10; an expulsion box 30 connected to the upper end of the transporting pipe 10; a filter 40 which encompasses the circumference of the upper end of the transporting pipe 10 which projects into the expulsion box 30; a hopper 50 connected beneath the expulsion side of the expulsion box 30; and a return pipe 60 connected between the lower end of the hopper 50 and the lower end of the transporting pipe 10.

The transporting pipe 10 is curved with it's lower end running along the floor so as to stand in an upright position. A medal intake 11 is set up at the lower end of the transporting pipe 10 with the return pipe 60 being connected just above this intake 11. As, shown in FIG. 1, the upper end 12 of the transporting pipe 10 is inclined along the slope of the filter 40 in the direction of expulsion of the medals, with the plane of the opening of the upper end 12 being inclined so as to be approximately parallel with the incline of the filter 40. This sloping of the plane of the opening serves to limit the expulsion direction of the medals and make the medals fall at the fastest possible speed. The angle of the incline of the plane of the opening should therefore be set appropriately with this aim in mind and may be set, for example, at an angle of inclination which is greater than that for the filter 40.

Also, as shown in FIG. 1, the structure is such that the drop from the plane of the opening to a first filter 40*a* near the upper end 12 of the transporting pipe 10 is smaller than the diameter of a medal. This reduces the surface area the medals come into contact with and the likelihood of stoppages is therefore decreased.

The upper end of the spiral member 20 is attached to the output axis of a motor 21 affixed to the upper part of the expulsion box 30 protruding from the upper end of the transporting pipe 10. The lower end of the spiral member 20 then extends down as far as the lower end of the intake 11 of the transporting pipe 10. The motor 21 acts as a driving mechanism, driving the spiral member 20 from it's upper end.

As shown in FIG. 3, the filter 40 is constructed from a board, the material for which is in the form of a grille. This may be, for example, a metal board having a large number of square holes or slits of a size which allows the cleaning material to pass through but does not allow the medals to pass through. This filter 40 actually consists of the first filter 40*a* and a second filter 40*b* connected in succession. The first filter 40*a* lies within the expulsion box 30 so as to encompass the circumference of the upper end 12 of the transporting pipe 10. The second filter 40*b* covers the upper part of the hopper 50.

An auxiliary filter 41 is also set up at the uppermost edge of the opening for the upper end 12 of the transporting pipe 10. This auxiliary filter 41 is also formed as a grille, in the same way as the filter 40.

Next, the cleaning, transporting and separating of the medals from the cleaning materials will be described for this invention.

The transporting pipe 10 and/or the return pipe 60 is/are filled with a prescribed amount of cleaning material such as nylon etc. in preparation. The medals K are then introduced via the intake 11 and the motor 21 is activated so that the spiral member 20 is made to rotate. The medals K are jumbled together with the cleaning material J due to the rotations of the spiral member 20 and rise within the pipe. During this time, grime etc. is removed from the medals K as the result of strong friction with the cleaning material J. The medals K then rise to the upper end of the transporting pipe 10 together with the cleaning material J.

The plane of the opening at the upper end 12 of the transporting pipe 10 is slanted so as to follow the angle of inclination of the filter 40. Therefore, as shown in FIG. 1, the medals K and cleaning material J which rise to the upper end of the transporting pipe 10 are pushed by the medals K and cleaning material J which succeed them and therefore slip reliably onto the filter 40 in succession. This is to say that they slip onto the first filter 40*a* and the second filter 40*b* before being ejected from an outlet which is not shown in the diagrams. The medals K therefore fall onto the first filter 40*a* without being held-up whichever way the medals K rise out from the upper end of the transporting pipe 10.

The reason for the medals K being smoothly ejected is as follows. Medals which are pushed up within the transporting pipe 10 by the spiral member 20 are released from the restraining effects of the transporting pipe 10 at the upper end 12. During this time, the medals are expelled radially equally at the edge of the opening plane in the conventional structure. So, it is difficult to exert force on the medals in the horizontal direction with the conventional structure. i.e. the speed of motion in the direction of the filter 40 is in the region of zero. With the present invention, however, a horizontal component of force acts on the medals as a result of the incline of the plane of the opening in the upper end 12 of the transporting pipe 10. The speed is therefore not zero for a large portion of the medals at the time of ejection at the edge of the opening as a result of the acceleration of the medals due to the horizontal force component and the medals therefore flow without hold-ups. Also, the medals K, from the top of the incline of the plane of the opening down to the bottom, all move smoothly in the same direction as a result of the same horizontal force component being exerted on all of them. The medals K therefore tend to be ejected in a direction corresponding to the direction of the incline of the plane of the opening at the upper end 12 of the transporting pipe 10.

The ejection-of the medals also becomes smoother simply as a result of the plane area of the opening being increased due to the plane of the opening at the upper end 12 of the transporting pipe 10 being formed at an incline.

The auxiliary filter 41 set-up at the upper edge of the upper end 12 of the transporting pipe 10 then prevents medals K from becoming caught-up at the back of the transporting pipe 10.

On the other hand, the cleaning material J which has risen-up falls into the hopper 50 via the first filter 40*a* or the auxiliary filter 41, or the second filter 40*b*. The cleaning material J that falls into the hopper 50 returns to the intake 11 via the return pipe 60 and is then re-used.

In this way, with the aforementioned medal cleaning apparatus, the medals K slip reliably onto the filters and are then ejected. Troublesome work such as the removal by hand of medals K which become stuck is therefore no longer necessary.

What is claimed is:

1. A medal cleaning apparatus for mixing and jumbling medals and cleaning material, cleaning the medals, separating the medals and the cleaning material and then expelling the medals comprising:

a transporting pipe, a lower end of said transporting pipe having an inlet for taking-in the medals and the cleaning material and an upper end of said transporting pipe becoming a medal expulsion outlet;

a spiral member, installed within said transporting pipe, for mixing, jumbling and transporting the medals and the cleaning material;

a driving mechanism for rotating said spiral member;

a filter, set up around the upper end of said transporting pipe and extending from one side of the upper end of said transporting pipe; and a return pipe for guiding the cleaning material separated at said filter to the lower end of said transporting pipe, wherein said filter is arranged in such a manner as to be inclined downwards in the direction of progress of the medals and the plane of the medal expulsion outlet at the upper end of said transporting pipe is inclined downwards in the direction of expulsion of the medals in such a manner as to follow the incline of said filter.

2. A medal cleaning apparatus according to claim 1, said plane of the medal expulsion outlet at the upper end of said transporting pipe being almost parallel with the surface of said filter.

3. A medal cleaning apparatus according to claim 2, said apparatus being further equipped with an auxiliary filter positioned at a part of surroundings of the upper end of said transporting pipe.

4. A medal cleaning apparatus according to claim 1, wherein a stepped difference between the upper end of said transporting pipe and said filter is of a height which is less than the diameter of the medals.

* * * * *